US007429223B2

(12) United States Patent
Dovrat et al.

(10) Patent No.: US 7,429,223 B2
(45) Date of Patent: Sep. 30, 2008

(54) GATE FOR A PADDLE AND BALL GAME

(76) Inventors: Michael Dovrat, 18 Kineret Street, 44201 Kfar Saba (IL); Eithan Nave, 1 HaEgoz Street, 81510 Yavneh (IL)

( * ) Notice: Subject to any disclaimer, the term of this patent is extended or adjusted under 35 U.S.C. 154(b) by 10 days.

(21) Appl. No.: 10/533,591

(22) PCT Filed: Jan. 6, 2004

(86) PCT No.: PCT/IL2004/000007

§ 371 (c)(1),
(2), (4) Date: May 3, 2005

(87) PCT Pub. No.: WO2004/060495

PCT Pub. Date: Jul. 22, 2004

(65) Prior Publication Data

US 2006/0091609 A1 May 4, 2006

(30) Foreign Application Priority Data

Jan. 7, 2003 (IL) ..... 153822

(51) Int. Cl.
*A63B 63/00* (2006.01)
*A63B 67/00* (2006.01)

(52) U.S. Cl. ..... 473/474; 473/459; 473/490; 473/462; 473/469; 473/476

(58) Field of Classification Search ..... 473/474, 473/459, 490, 462, 422, 428, 439, 454, 456, 473/465, 469, 476, 477; 273/317, 348, 354, 273/398, 402
See application file for complete search history.

(56) References Cited

U.S. PATENT DOCUMENTS 712,231 A * 10/1902 Alexander ..... 473/469
3,945,641 A 3/1976 Carbonero
3,980,299 A * 9/1976 Brown ..... 473/474
4,072,295 A 2/1978 Roberts
4,231,572 A * 11/1980 Thornton ..... 473/462
4,436,304 A * 3/1984 Castleman et al. ..... 473/462
4,441,719 A 4/1984 Lohr
4,457,513 A 7/1984 Thompson
4,718,668 A 1/1988 Schipske
4,826,178 A 5/1989 Cloran
4,880,243 A * 11/1989 Raub ..... 473/490
5,018,746 A * 5/1991 Cardoza et al. ..... 473/474
5,058,899 A * 10/1991 Jackson et al. ..... 473/469

(Continued)

FOREIGN PATENT DOCUMENTS

RO 116527 3/2001

(Continued)

*Primary Examiner*—Raleigh W. Chiu
(74) *Attorney, Agent, or Firm*—Blum, Gador & Co; Deborah Gador

(57) ABSTRACT

The invention relates to a gate apparatus for a paddle and ball game, to a game including the same and to methods for playing the game. The gate apparatus comprises a frame for delimiting a closed region above the ground for a ball to be transferred therethrough and a base element for elevating and stabilizing the frame above the ground. The gate can be permanently installed or can be a portable gate. Preferably the gate is assembled from components disengageably connected to each other.

32 Claims, 7 Drawing Sheets

U.S. PATENT DOCUMENTS 5,301,955 A 4/1994 Fedullo
5,333,856 A 8/1994 Gery
5,403,000 A 4/1995 Woosley
5,474,301 A * 12/1995 Wilson ..... 473/490
5,584,487 A * 12/1996 Blue ..... 473/469
5,681,231 A 10/1997 Reeves
5,803,841 A 9/1998 Daskoski
5,863,265 A 1/1999 Acton
5,865,691 A 2/1999 Chen
6,093,120 A 7/2000 Luke, Jr.

FOREIGN PATENT DOCUMENTS

WO WO2004/060495 7/2004

* cited by examiner

GATE FOR A PADDLE AND BALL GAME

BACKGROUND OF THE INVENTION

1. Field of the Invention

The present invention relates to ball games in general and to paddle and ball games in particular.

2. Discussion of the Related Art

Many various ball games are known in the art. In particular relevant to the present invention are games in which a bouncing ball is transferred back and forth between two opposing players (or pairs of players) by means of rackets or paddles. Games belonging to this category, such as tennis, table tennis (ping-pong) squash etc. are played at special courts and require special equipment. Lawn tennis is played at a rectangular court of a specific dimensions divided into two equal halves by a net. The two opposing players, each positioned at his corresponding half court, use strung rackets to hit a ball of specified size, weight, and bounce over the net. The object is to hit the ball so that it goes over the net and bounces on the opponent's half court in such a way that the opponent cannot reach it or return it correctly. Points are awarded to a player whenever the opponent fails to correctly return the ball within the prescribed dimensions of the court. Table tennis is a game similar in principle to lawn tennis but played on a flat table divided into two equal courts by a net fixed across its width at the middle. The two players are standing facing each other across the table, hitting a small hollow plastic ball by means of rubber-covered rackets. As in lawn tennis, the object is to hit the ball over the net such that it will hit the opponent's court but will not be returned by the opponent. When a player fails to return the ball, or when the ball does not hit the opponent's court, his opponent is awarded a point. Squash is another racket and ball game played in a four-walled court with a long-handled strung racket and a small rubber ball. The object of the game is to bounce, or rebound, the ball off the front wall in such a way that the opponent is unable to reach it and rebound it off the front wall in his turn. The four walls serve as the boundaries of the court. The games mentioned above, having defined rules, are very highly organized as a competitive sport.

Another ball game, hereinafter referred to as "paddle and ball game" or "beach paddle and ball game", is a game in which two players directly transfer a resilient ball back and forth between them by means of wooden or plastic paddles of a relatively short handle. The game is very popular as recreational sport in open areas and especially around beaches where the ground is soft or sandy and where a ball does not rebound to a significant height once it hits the ground. Therefore, in this game, unlike the games mentioned above, the ball does not hit any intermediate surface between paddle strokes but is directly transferred between the players.

Although beach paddle game is very popular in some countries, there are no rules to the game, nor a scoring method such that there is no way to determine who is the best player or the winner. One of the problems preventing beach paddle game from being a competitive game is that the game is not played in a defined area with defined borders. Another problem is that there is no intermediate surface that slows the ball. It is therefore almost impossible to return strong strokes, more so when they are not accurately directed to the opposite player. There is therefore a need to enhance beach paddle game such that it can be played in a competitive way.

Accordingly, it is an object of the present invention to overcome the aforementioned problems in order to enhance a common beach paddle game into a competitive game where rules and scoring can be employed, while at the same time keeping the popular nature of the game such that it may be played in any open area with no need for expensive equipment, nor for a special court. Furthermore, imparting the game competitive qualities will enhance introducing and spreading the game to countries and areas where it is still not sufficiently known.

SUMMARY OF THE PRESENT INVENTION

One aspect of the present invention is a gate apparatus for a paddle and ball game. The gate comprises a frame for delimiting a closed region above the ground for a ball to be transferred therethrough and a base element for elevating and stabilizing the frame. The frame may be of any closed shape, preferably the frame is of a rectangular shape. The size of the frame can be either fixed or adjustable. The gate can be either permanently installed or can be a portable gate. Preferably the gate is assembled from components disengageably connected to each other, such that the gate may be disassembled for facilitating compact storage and may be easily carried to be positioned in any suitable area. According to one embodiment of the present invention the frame comprises rods of adjustable dimensions for allowing adjustment of the frame size according to the age and skill of the players. Yet in accordance with another embodiment of the invention, the frame comprises a reinforced net supported by two vertical rods.

A second aspect of the invention is a game assembly for a paddle and ball game comprising a plurality of rods disengageably connected to each other for forming a frame delimiting a closed space above the ground, at least two paddles and a resilient ball.

Another aspect of the invention is a competitive paddle and ball game for two players or two pairs of players, the game comprising at least one gate apparatus of the invention, a paddle for each player, a resilient ball and a set of rules and regulations for scoring points to win the game. The rules and regulations involve transferring the ball in air through the closed area of the gate by means of the paddles. According to one embodiment, the gate apparatus may be positioned between the two players. Yet according to another embodiment the game comprises two gate apparatuses positioned a space apart and the two players are standing each in front of one of the gate apparatuses.

A further aspect of the invention is a method for playing a paddle and ball game, the method comprising installing at least one gate apparatus of the present invention in any suitable area, and transferring a resilient ball by means of paddles through the gate. The method may further comprise marking at least one defined area on the ground for regulating movements of the ball and/or the players in relation to the at least one defined area.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

The present invention is aimed at enhancing a paddle and ball game such that the game can be played in a competitive manner. Accordingly, the invention provides a gate for delimiting a defined space above the ground, through which the ball should pass when transferred in air between payers.

The delimitation of a defined area above the ground for the ball to pass therethrough, has many advantages. First it provides a reference for setting rules for the game and for scoring method. For example, a rule may be set that when a player misses the gate, the opponent player scores a point. Secondly, it regulates both the direction and speed of the ball, thus enabling strokes to be replied. As described above, when there are no defined borders to the game, a player may hit the ball in any direction and there is no way to determine if the stroke was "legal". Once a specified area in air is defined by means of the gate, it is possible to determine if the ball passed through this area, i.e., if the stroke is legal or not. Thus, for example, if a player hits the ball through the gate and the opponent player fails to answer the stroke or fails to return the ball through the gate, the first player may score a point.

The introduction of a gate to a simple paddle and ball game opens numerous possibilities for formulating rules for the game and consequently for determining scoring methods. The advantage of the present invention is that this is achieved without requiring a special court or field, so that the game can be played anywhere where there is sufficient space on both sides of the gate for allowing free movements of the players. Thus, in a sense, the introduction of the gate into a paddle game converts the regular horizontal field into a vertical field.

The gate of the present invention can be either permanently installed or it can be a portable gate. Preferably, when portable, the gate comprises disegageably connectable components such that it may be disassembled into components to be easily carried and positioned in any suitable area. The gate comprises a frame for defining a closed region above the ground and at least one elevating and stabilizing element for stabilizing the frame above the ground. The stabilizing element may be an integral part of the frame or can be a separate element. The frame can assume any closed shape, preferably the frame is of a rectangular shape. The size of the frame can be either fixed or variable for allowing adjustment according to the age and skill of the players. In order to facilitate playing under dim conditions, the gate may be colored by or impregnated with fluorescent or phosphorescent agents to provide glowing effect after dark. Alternatively, the gate may be provided with portable illuminating means, such as a decorative electric line provided with small bulbs which can be attached to the gates for marking the frame's outline. Similarly, the paddles and ball may be provided with glowing or illuminating means as well.

Figure 1:
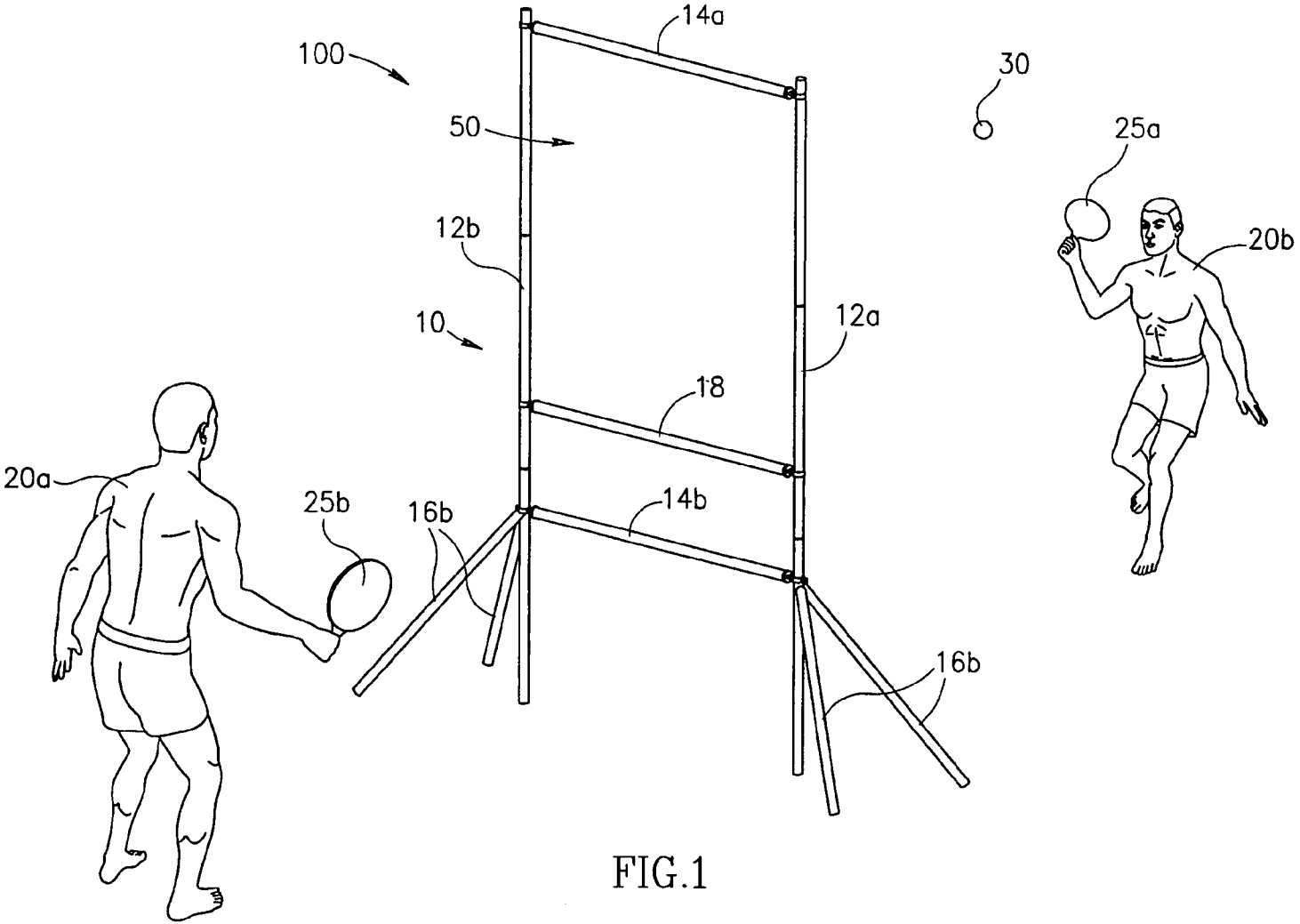
FIG. 1 is an illustration of a paddle and ball game in accordance with one embodiment of the present invention.
Figure 3:
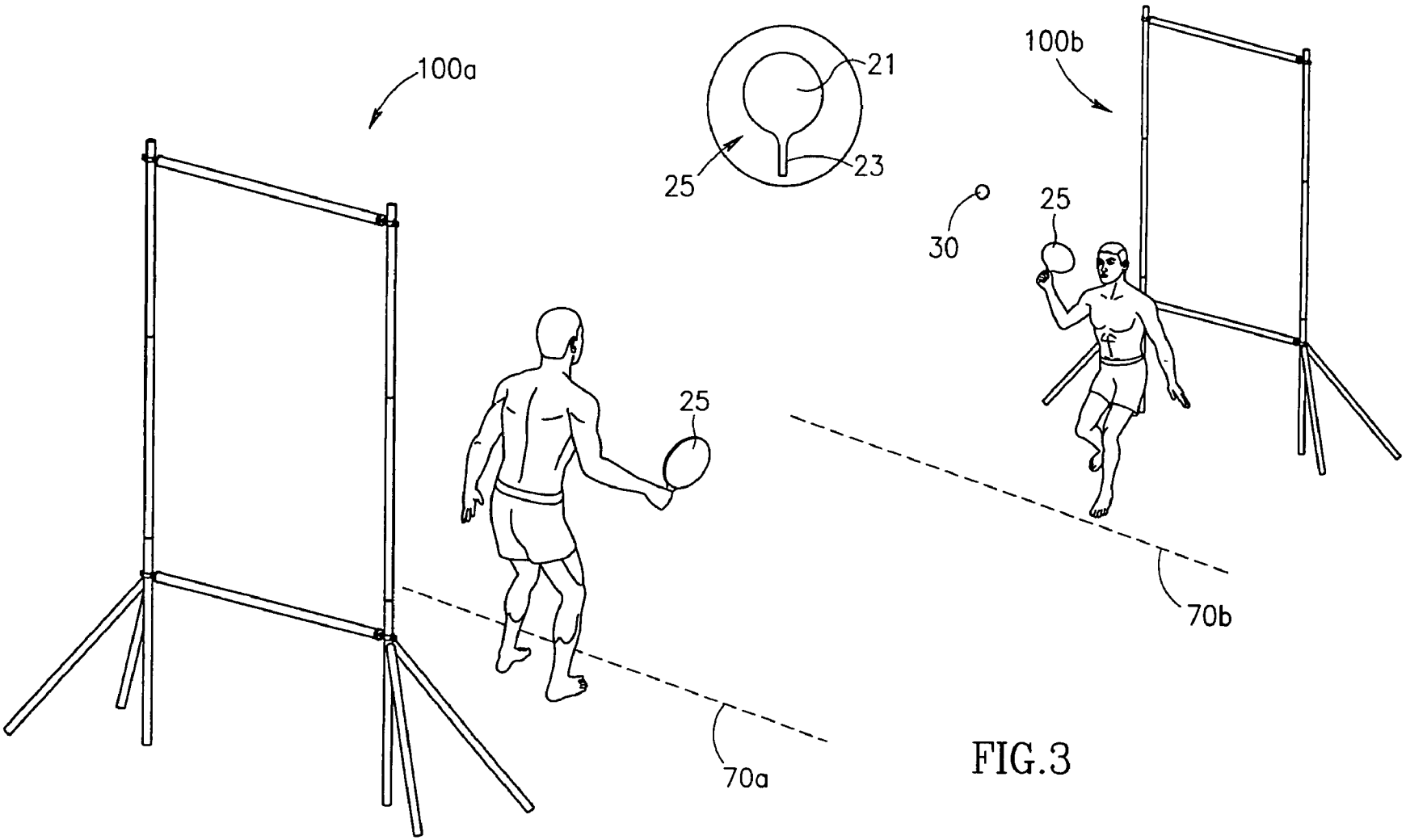
FIG. 3 is an illustration of a paddle and ball game in accordance with a second embodiment of the present invention

Referring now to FIG. 1 there is shown a first embodiment of a paddle and ball game in accordance with the present invention. A gate, generally designated 100, is installed on the ground, in an open area such as on a beach, in a park, etc. The gate may also be installed indoors where there is sufficient space on both sides of the gate for allowing free movements of the players for maneuvering the ball. Two players 20*a* and 20*b* are positioned on opposite sides of the gate, facing each other, holding paddles 25*a* and 25*b* respectively. In accordance with this embodiment, the aim of the game is to hit ball 30 by means of paddles 25 such that it will go through space 50 defined by frame 10. Paddles 25 may be any paddle or racket having a flat surface for hitting the ball and a handle attaches to the flat surface for gripping the paddle. Preferably paddles 25 are simple flat wooden paddles comprising a flat rounded surface 21 and a relatively short handle 23, as shown in the insertion of FIG. 3. Such paddles, commonly used in paddle and ball beach game, are simple and inexpensive. Ball 30 may be any resilient ball, preferably ball 30 is a full rubber ball similar in size and material to the ball used in a squash game. However it will be realized that any combination of paddles and ball may be used as long as the paddles and ball are compatible with each other. It will be also realized that the game can be easily adapted to be played by two pairs of players. For example, in the configuration shown in FIG. 1, a pair of players can be positioned on each side of the gate and a rule may be set that the players in each pair hit the ball alternately.

Gate 100 comprises two vertical rods 12*a* and 12*b* and two horizontal rods 14*a* and 14*b* where the lower section of rods 12 serves as the base element for elevating the frame above the ground. In the embodiment shown here, gate 100 further comprises two pairs of supporting rods 16*a* and 16*b* and an optional adjustable horizontal rod 18. Each pair of supportive rods 16 is connected to the corresponding vertical rod 12 at about one fourth to one third of its length above the ground, forming acute angle with rod 12 for supporting and stabilizing gate 100. Horizontal rod 18 is an optional rod which can be connected to vertical rods 12 at different heights for adjusting the size of space 50 according to the desired degree of difficulty of the game. Thus frame 10, enclosing space 50, is formed by vertical rods 12*a* and 12*b*, upper horizontal rods 14*a* and lower horizontal rod 18. It will be easily realized that the use of additional rod 18, in addition to allowing the adjustment of the size of frame 10, also enforces the construction of gate 100. Yet according to another embodiment, rod 18 is redundant and frame 10 is defined by verticals rods 12 and horizontal rods 14 alone. According to this embodiment, the size of frame 10 can be adjusted by adjusting the positions of rods 14*a* and 14*b*. It will be also realized that other means for allowing adjustable frame are possible. For example, in order to allow the adjustment of the frame width, rods 14 can be supplied in various sizes such that the players can choose the size most suitable for their skill. Alternatively, rods 14, as well as rods 12, may be telescopic rods comprising two or more pipes inserted into each other and sliding against each other for allowing length adjustment. According to this embodiment, a rod may be a symmetric telescopic rod comprising a central inner pipe and two or more wider pipes slidingly assembled on each side of the inner pipe such that the two ends of the rod are of an equal diameter. Preferably the length of rods 12 is in the range of 2.5 to 3.5 m while the length of rods 14 is in the range of 1 to 2 m. Rod 14*b* is preferably positioned at a height of 0.7 to 1.2 above the ground.

The adjustment of frame 10 allows various degrees of difficulty according to the age and skill of the players. For example, when the players are children, the lower and upper borders of space 50 can be chosen to be rods 14*b* and 18, respectively. For full height persons, rod 18 can be adjusted to fit the desired difficulty. It will be realized that the size of space 50 through which the ball is transferred dictates possible trajectories of the ball and the range on either side of the gate in which the ball may fall. Thus, reducing the size of space 50 requires more skill in directing the strokes while at the same time it also reduces the intensity of the strokes and consequently their range. However, since the intensity and range of the serving stroke still might be too large, it is possible to further limit this range by marking a specified area on each side of the gate to which the serving ball must be directed. Accordingly, a rule might be included that a failure to direct the ball into the specified range results in scoring a point to the non-serving player. Similarly, other areas around the gate and/or between the players might be marked for enhancing the complexity and difficulty of the game. For example, a court may be defined for each player that limits the movements of the player to the area within the defined court such that if a player crosses his/her court borders, he/she loses a point and/or his/her opponent scores a point. Preferably, the courts are located at a distance from the gate for preventing a player from getting too close to the gate either for serving a stroke or for blocking the stroke of the other player. Marking a defined area on the ground can be performed simply by drawing a line with a sharp object on the sand, by a chalk where possible, by stretching a cord around a set of pegs inserted into the ground, etc. Variations in the game in terms of strength and quickness required by the players may also be achieved by variations in the paddles and the ball, i.e., the paddle size, the bounce and weight of the ball, etc.

Figure 2:
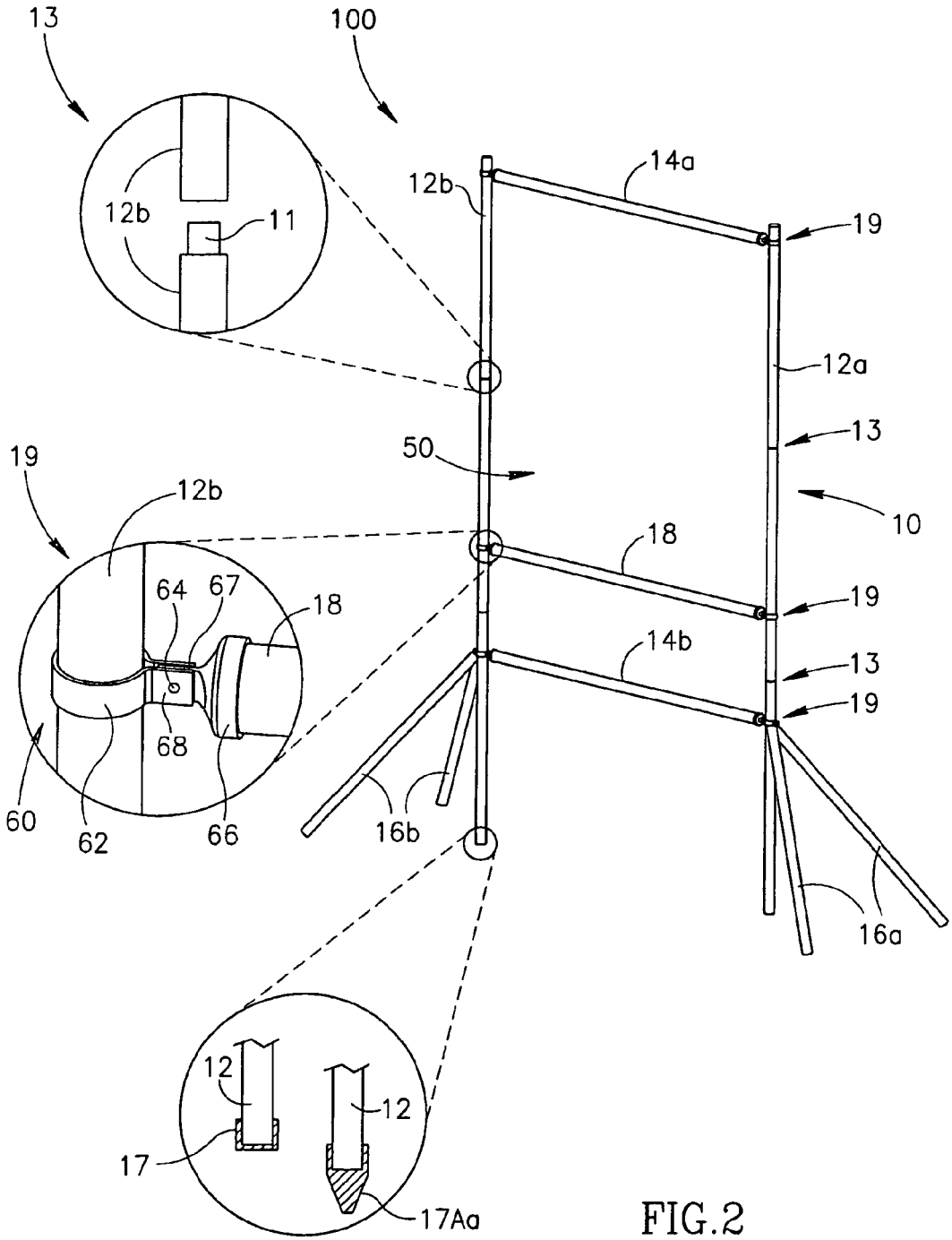
FIG. 2 is an illustration of a gate for a paddle and ball game in accordance with one embodiment of the present invention.

Turning now to FIG. 2, there is shown in detail a gate 100 in accordance with a preferred embodiment of the present invention. According to this embodiment, gate 100 is a portable gate, comprising of connectable rods to be easily assembled or disassembled for facilitating easy carrying and installation in any suitable area. Preferably the rods are hollow pipes of a circular cross section. The rods can be fabricated from any rigid endurable material such as endurable rigid plastic or metal coated with anti-rusting layer. The rods may be further colored or impregnated with luminous agents to provide a glowing effect for allowing playing under low-light conditions. In accordance with the embodiment shown in FIG. 2, each of rods 12 comprises three separate rods of preferably equal length insertable into each other at points 13. Horizontal rods 14 and 18 as well as rods 16 are connectable to rods 12 by connection means 19. The vertical position of rods 14 and 18 can be adjusted to obtain the desired size of frame 10 and its height above the ground by lifting or lowering the rods. In accordance with this embodiment gate 100 can be disassembled into twelve separate rods for facilitating compact storage. It will be easily realized that the number of the separate rods which comprise gate 100 may vary. For example, the gate may comprise twenty-two rods of 75 cm such that each of rods 12 comprises four sections to obtain a full length of 3 m while rods 14, 16 and 18 each comprises two sections to obtain a full length of 1.5 m.

Also shown in the exploded views of FIG. 2 are the connection means at points 13 and 19 and the lower ends of vertical rods 12. In accordance with the embodiment shown here, each of the sections of rod 12 terminates with an inner narrower circular end fitted into the wider second end of another rod section. The lower end of rod 12, as well as the lower ends of rods 16, may be provided with a cup-like 17 fitted onto the end for providing a flat base and for enhancing the stabilization of the rod on the ground. The flat bottom cups 17 can be replaced by a tapering cup 17*a* for allowing insertion of the rod into the ground where the ground is soft, e.g. sand, for enhancing stabilization. The gate assembly may be supplied with both cups 17 and 17*a* to be used according to the area in which the gate is installed. Rods 14, 18 and 16 are adjustably connected to vertical rods 12 by means of clamps 60. Clamp 60 comprises an open circular portion 62 for encircling rod 12 which terminates with two flat tongues 68 having holes 64 for inserting a bolt therethrough. A cup 66 for receiving a second rod is pivotally connected to part 62 by means of flat extension 67 positioned between tongues 68 and having a corresponding hole for the bolt to pass through. By fastening the bolt, a rod inserted into cup 66 can be locked in place, fixedly connected to vertical rod 12 at any desired angle, i.e. perpendicular as rods 14 and 18 or forming an acute angle with rod 12 as in the case of rods 16.

It will be easily realized that the connection means shown in FIG. 2 are only examples and that any other known in the art connection means for connecting rods and pipes, either continuously, or to form an angle with each other, may be used. It will be also realized that in other embodiments gate 100 may comprise a foldable construction having bendable joints, or by a combination of a number of foldable components.

In the embodiment shown in FIG. 2, the size of frame 10 may be adjusted by lowering or raising rod 18, thus varying the effective height of frame 10. It will be realized that other means may be used for allowing adjustable frame. For example, gate 10 may be comprised of telescopic tubular rods of adjustable length allowing adjustment of both width and height of frame 10.

Figure 2A:
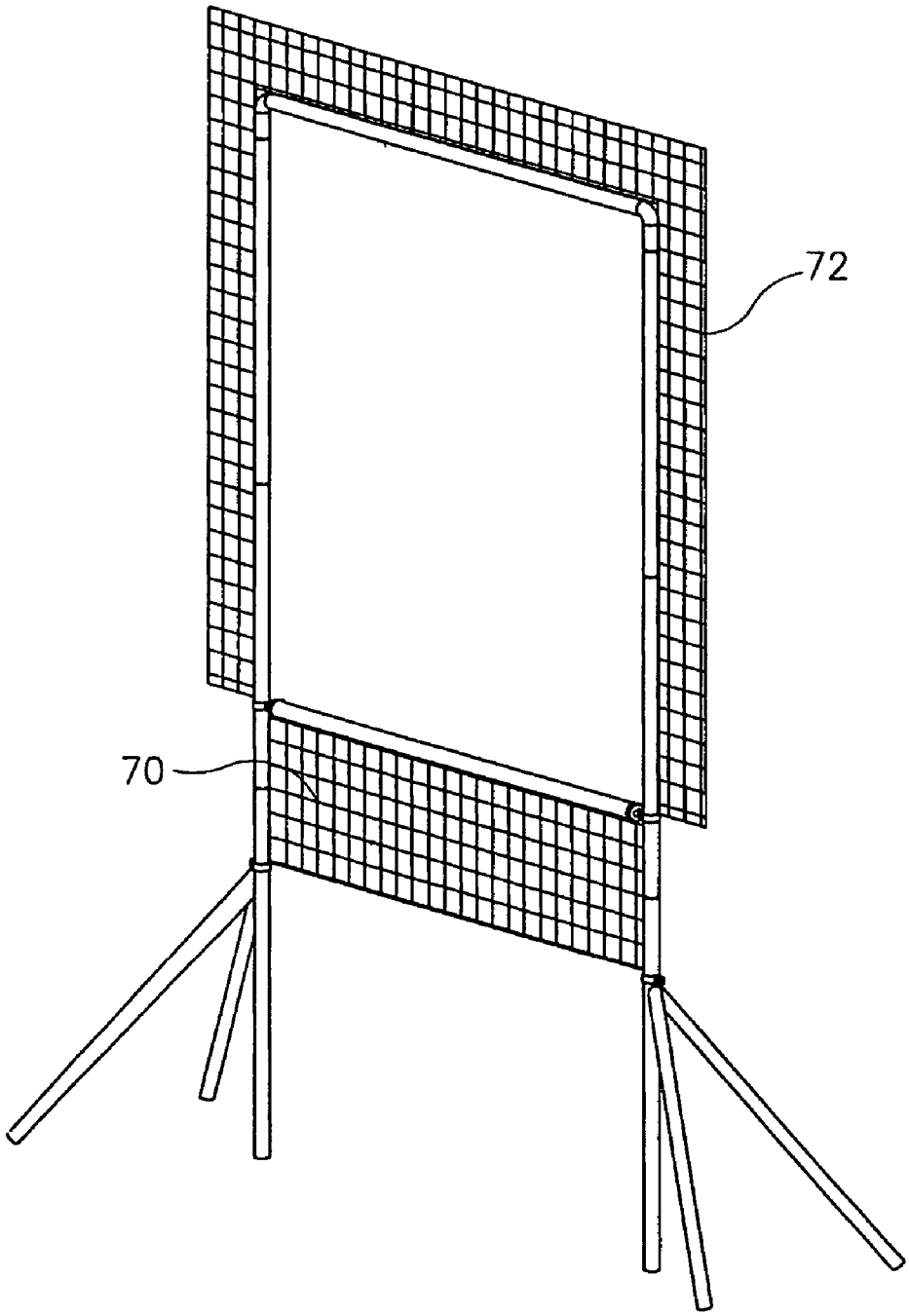
FIG. 2A is an illustration of a gate for a paddle and ball game in accordance with another embodiment of the present invention.

FIG. 2A shows yet another embodiment in which frame 10 is further provided with a peripheral net for returning balls which pass close to, but not through, the frame, i.e., on the outward side of the frame. In the embodiment shown here, the net comprises a lower net section 70 extending between rods 14*b* and 18 and a peripheral net section 72 outwardly surrounding the upper and side ends of frame 10. The net can be attached to frame 10 by various means. For example the net might include rigid extensions insertable into corresponding receiving holes in the outward surface of frame 10. Alternatively, the net may be rolled inside the hollow rods such that it can be pulled out through a suitable elongated notch extending along the outward surface of frame 10. Yet in accordance with a further embodiment, the net may be stretched between the rods by means of various fastening means, such as hooks, Velcro® straps and the like.

Figure 2B:
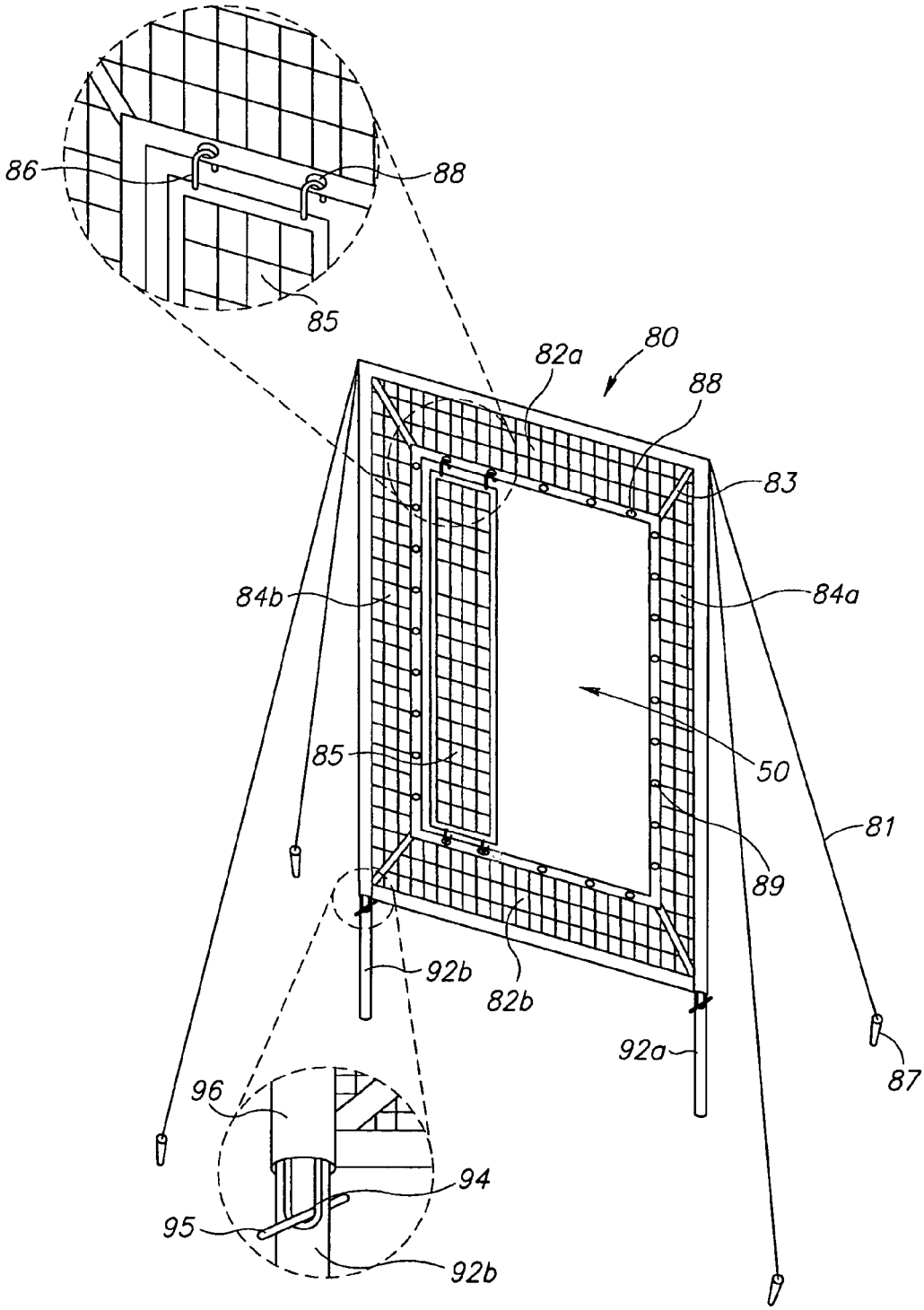
FIG. 2B is an illustration of a gate for a paddle and ball game in accordance with yet a further embodiment of the invention.

Another embodiment of a gate for a paddle and ball game of the invention, according to which the frame of the gate is not fully comprised of rigid elements, is depicted in FIG. 2B. In accordance with this embodiment, the gate comprises a frame made of a rectangular net 80 comprising two vertical opposed sides 84*a* and two opposed horizontal sides 82*a* and 82*b*, leaving an opening 50. Net 80 can be made of any suitable material such as nylon or polyester cords and may assume some elasticity. Preferably, net 80 is made of endurable water-resistant cords. In order to facilitate playing under low-light conditions, net 80, or parts thereof, may be colored or impregnated with luminous agents to provide a glowing effect under dark. Alternatively, small bulbs may be attached to the net for illuminating the net. Net 80 is stretched between two vertical rods 92*a* and 92*b*. In accordance with the embodiment shown here, vertical rods 92*a* and 92*b* are inserted through sleeves 96 extending along the outer rims of vertical sides 84. However, it will be easily realized that net 80 may be attached to rods 92 by other means. For example, the outer vertical rims of the net may be provided with hooks that may be inserted into corresponding openings in the rods, with Velcro® strips for encircling the rods, and the like. The lower ends of vertical rods 92 are inserted into the ground at a distance equal to the net width such that net 80 is stretched between the rods. It will be realized that vertical rods 92 may be assembled from a number of connectable shorter rods to expand their full length, as described above in association with FIG. 2. It will be appreciated that forming the frame from a net allows for returning balls which miss to pass through the opening and facilitates determining fault strokes. In order to maintain net 80 in a stretched condition, the lower corners of the net are provided with attaching means for fastening the corners to vertical rods 92. Such means may be, for example, a pair of loops 94 provided at each lower corner of net 80 which are wrapped around corresponding pins 95 protruding from rods 92, as shown in the lower exploded view of FIG. 2B. Preferably, loops 94 are made of elastic material such as rubber band. Other means for maintaining the net in a stretched position may be springs provided at the lower edges of net 80 having their free ends provided with hooks that can be either fastened around pins 94 or inserted into corresponding openings (not shown) in the rods. Net 80 is also provided with reinforcing diagonal segments 83 and with reinforcing outer and inner rims for maintaining a flat and stretched condition of the net. The inner and outer rims of net 80 as well as diagonal segments 83 may be made of cloth, plastic sheet and the like. In order to stabilize the gate and to keep it in an upright position, two pairs of cables 81 are extending from the upper corners of the net in opposed directions to be tied around pegs 87 inserted into the ground. Additional two pairs of cables and pegs (not shown) may also be provided at the lower corners of the net for further stabilizing the apparatus and for keeping the net in a stretched position. Such additional pairs of cables may be provided in addition to the fastening means mentioned above or may replace them.

Adjustment of the size of opening 50 in accordance with the desired degree of difficulty may be achieved by a number of ways. One such way is by providing additional net pieces, a vertical piece net piece 85 and horizontal net piece (not shown) which can be hung on the main net 80 by means of hooks 86 adapted to be inserted into horizontal loops 88 and vertical 89, respectively, as shown in the upper exploded view of FIG. 2B. Alternatively, reducing the size of opening 50 may be achieved by connecting chosen pairs of vertical and horizontal loops 88 and 89, respectively, by means of, for example, springs provided with hooks at their ends, such as to proximate the vertical and horizontal inner rims of net 80 to each other, thereby reducing the size of opening 50. It will be realized that in accordance with this method, opening 50 in its reduced size will assume a non-rectangular shape. Yet, in accordance with another embodiment, a thread, may be threaded along the inner perimeter of net 80 having its two ends extending from an opening in the rim to allow contracting the inner perimeter of the net by pulling the two ends of the thread outwardly, and tying them to each other to prevent their retraction. Such a thread may be an elastic thread such as a rubber band.

It will be appreciated that the gate apparatus depicted in FIG. 2B can be easily disassembled into its components, namely net and rods, and packed into a compact package which can be easily carried from one place to another. Yet, it will be also realized, that in accordance with other embodiments, net 80 may be permanently connected to rods 92, or parts thereof. For example, where rods 92 are assembled from a number of elements the upper elements may be permanently inserted through sleeves 96. This will allow for rolling the net around the rods and facilitating packing the apparatus.

FIG. 3 shows another embodiment of a paddle and ball game according to which two identical gates of the present invention, designated 100*a* and 100*b*, are positioned space apart. The two players 20*a* and 20*b* are standing in front of the gates, each with his back to the corresponding gate holding paddles 25. According to this embodiment the aim of the game is to hit the ball through the opponent's gate. According to the embodiment shown here, the position of each of the players is restricted to a defined zone in front of his corresponding gate as defined by foul lines 70*a* and 70*b*.

Figure 5:
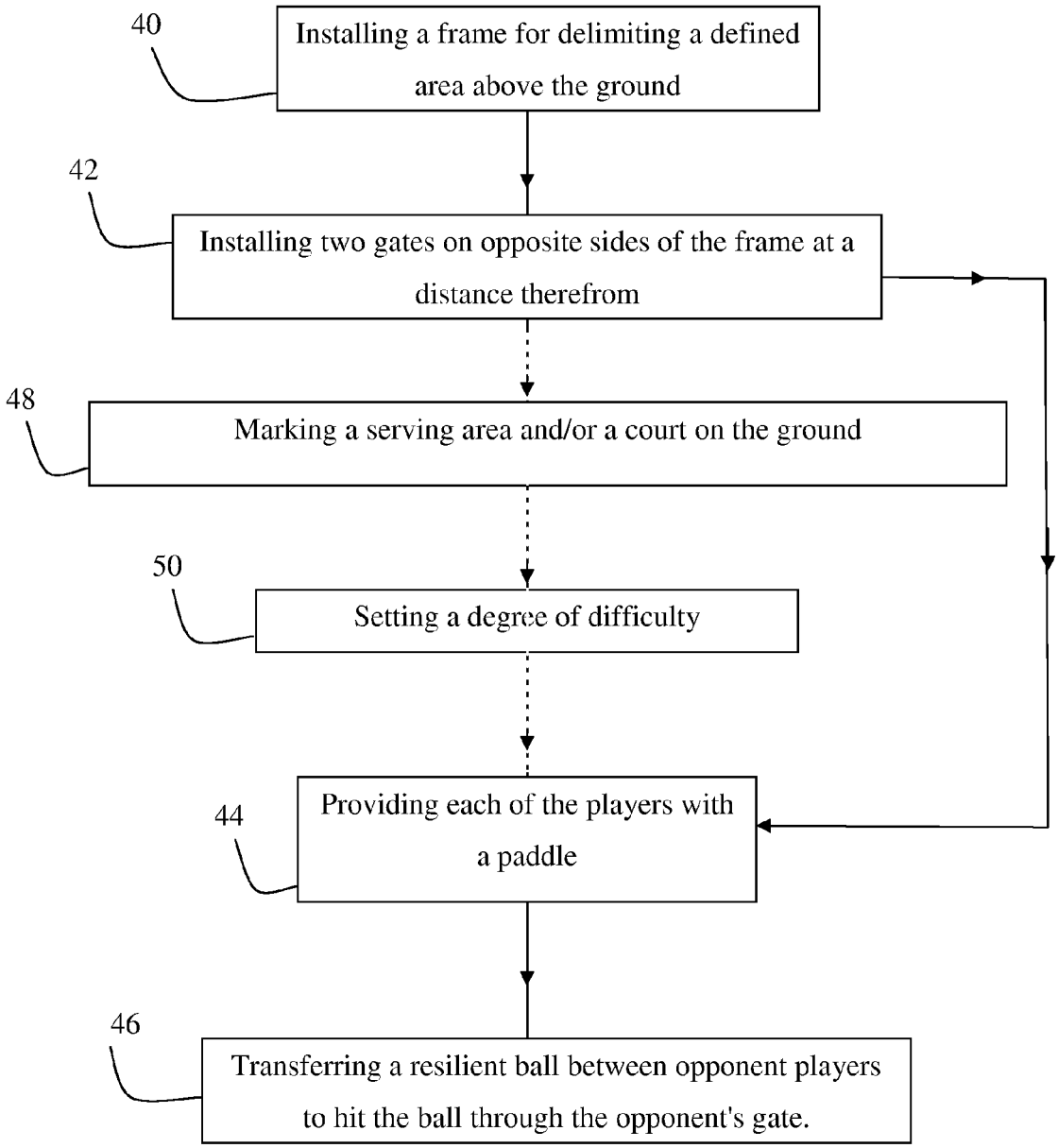
FIG. 5 is a flow chart of steps taken when setting up and playing the game.

A method for playing a paddle and ball game by two opponent players, according to one embodiment of the invention, is illustrated in block diagram form in FIG. 5. According to the illustrated method, a frame for delimiting a defined area above the ground is installed (block 40). Two gates (goals) are installed (block 42) on opposite sides of the frame at a distance therefrom. Each of the two gates is associated with one of the opponent players. Each of the players is now provided (block 44) with a paddle and the opponent players transfer a resilient ball (block 46) between themselves by means of the paddles through the defined area and toward the opponent's gate to hit the ball through the opponent's gate. If desired, at least one defined area can be marking on the ground for regulating movements of the ball and/or the players in relation to the at least one defined area, i.e., a serving area or a court (block 48). If desired, the degree of difficulty of the game can be set (block 50), as by at least one of the following: the frame size, the gate size, the distance between the frame and the gate, the type of the ball, the type of the paddles and by the at least one defined area on the ground.

Figure 4:
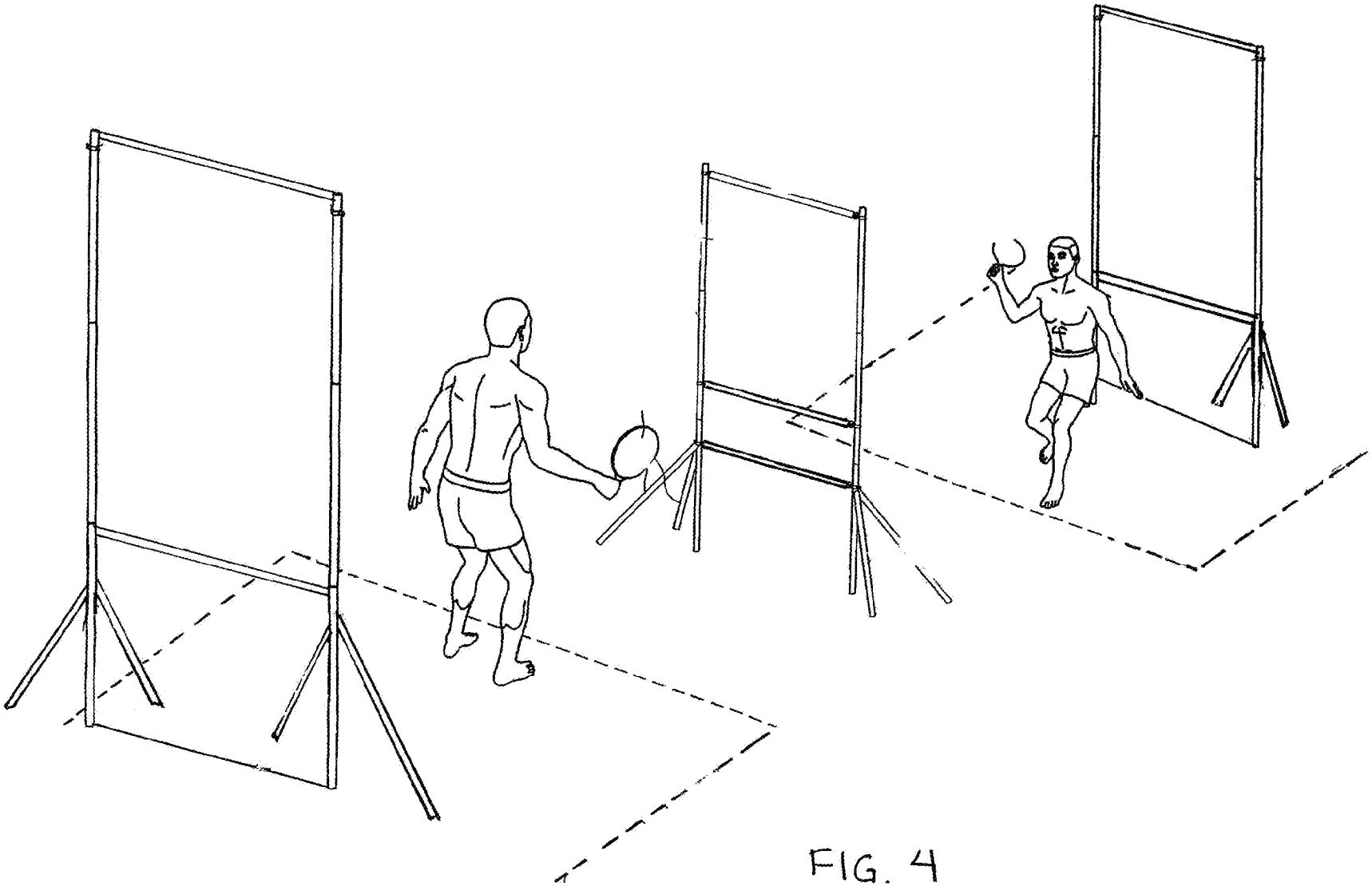
FIG. 4 is a schematic illustration of a paddle and ball game in accordance with a further embodiment of the present invention.

It will be realized that many other variations of the game are possible by introducing any number of gates of the present invention. For example, gates may be placed between the players and also behind them, i.e., a combination of the embodiments depicted in FIGS. 1 and 3, and shown in FIG. 4, wherein the aim is to hit the ball through the opponent's gate but the ball also must pass through the middle gate. Furthermore, the gate apparatus of the present invention can be further provided with other sport and game devices, for enhancing the recreational nature of the device, by utilizing the construction and portability of the gate. Such devices can be, for example, a basketball hoop, a dart game table, etc., which can be easily hung on the gate. Thus, the device can be used as a portable, multi-functional recreation center.

It will be appreciated by persons skilled in the art that the present invention is not limited to what has been particularly shown and described hereinabove. Rather the scope of the present invention is defined only by the claims which follow.

The invention claimed is:

1. A game apparatus for a paddle and ball game to be played by two opposing players or by two opposing pairs of players, each of the players is provided with a paddle, the apparatus comprising, a frame delimiting a defined area above the ground for a ball to be transferred therethrough by means of a paddle; and two gates positioned opposite each other on opposite sides of said frame at a distance therefrom; wherein the opposing players or pair of players are positioned on opposite sides of the frame, each between the frame and one of the gates, and wherein said gates are positioned such that said resilient ball can be transferred between opponent players by means of said paddles through said defined area and toward the opponent's gate to hit the ball through the opponent's gate.

2. The game apparatus of claim 1 further comprising marking elements for defining at least one defined area on the ground for regulating movements of the ball and/or the players in relation to the at least one defined area on the ground.

3. The game apparatus of claim 2, wherein said at least one defined area on the ground comprises two areas, one in front of each gate and wherein each of the players is restricted to the area in front of his corresponding gate.

4. The game apparatus of claim 3, wherein the gates are of an adjustable size for allowing adjustment of the gate according to desired degree of game difficulty or in accordance with age and skill of the players.

5. The game apparatus of claim 2, wherein said marking elements are a cord and pegs.

6. The game apparatus of claim 1, wherein the frame is of an adjustable size for allowing adjustment of the frame according to desired degree of game difficulty or in accordance with age and skill of the players.

7. The game apparatus of claim 1, wherein said distance is determined according to a desired degree of game difficulty or in accordance with age and skill of the players.

8. The game apparatus of claim 1, wherein the apparatus is a portable apparatus comprising components disengageably connected to each other.

9. The game apparatus of claim 1, wherein the frame is of a rectangular shape.

10. The game apparatus of claim 1, wherein the frame is provided with a net.

11. The game apparatus of claim 10, wherein said net defines an opening.

12. The game apparatus of claim 11, wherein the net is further provided with means for adjusting the size of the opening.

13. The game apparatus of claim 12, wherein said means are additional net segments attachable to the net.

14. The game apparatus of claim 12, wherein the net has an inner rim and said means include a thread threaded through said inner rim, the two ends of the thread extending through an opening in said inner rim for allowing pulling the ends to contract said inner rim.

15. The game apparatus of claim 1, wherein each of said two gates is provided with a net.

16. The game apparatus of claim 1 further comprising glowing or illuminating means for facilitating playing under dim conditions.

17. The game apparatus of claim 1, wherein said frame and gates are provided with a base element for stabilizing the frame and gates above the ground.

18. The game apparatus of claim 1, wherein said frame and gates are provided with tapering endings for allowing inserting the frame and gates into the ground.

19. A game assembly for a paddle and ball game, the assembly comprises a plurality of elements disengageably connected to each other for forming a frame delimiting a closed space above the ground and two gates and at least two paddles and a resilient ball, said gates being arranged to be disposed opposite each other on opposite sides of said frame and distanced therefrom such that a ball passing through said closed space can pass through at least one of said gates.

20. The game assembly of claim 19, wherein said elements include rods.

21. The game assembly of claim 19, wherein said elements further include a net.

22. The game apparatus of claim 21, wherein said net has an opening.

23. A competitive paddle and ball game for two opponent players or two opponent pairs of players, the game comprises a frame for delimiting a closed area above the ground; two gates, each associated with one of the opponent players, the gates are positioned on opposite sides of said frame at a distance therefrom; a paddle for each player; a resilient ball; said gates being positioned such that said resilient ball can be transferred between opponent players by means of said paddles through said closed area and toward the opponent's gate to hit the ball through the opponent's gate; and a set of rules and regulations for scoring points to win said game; wherein the opponent players are positioned on opposite sides of said frame, each between the frame and one of the gates and wherein said rules and regulations involve transferring the ball in air through said closed area by means of said paddles.

24. The game according to claim 23, wherein the frame comprises a net having an opening.

25. The game according claim 24, wherein said opening in said net delimits said closed area.

26. The game according to claim 23 further comprising at least one defined area marked on the ground for delimiting movements of the ball and/or a player in relation to said at least one defined area.

27. The game according to claim 26, wherein said at least one defined area on the ground comprises two areas, one in front of each gate, wherein each of the players is restricted to the area in front of his corresponding gate.

28. A method for playing a paddle and ball game by two opponent players, the method comprising installing a frame for delimiting a defined area above the ground; installing two gates on opposite sides of said frame at a distance therefrom, each of the two gates is associated with one of the opponent players; providing each of the players with a paddle; and transferring a resilient ball between opponent players by means of said paddles through said defined area and toward the opponent's gate to hit the ball through the opponent's gate.

29. The method of claim 28, further comprising marking at least one defined area on the ground for regulating movements of the ball and/or the players in relation to the at least one defined area.

30. The method of claim 29, wherein the at least one defined area on the ground defines the area into which a serving ball must be directed and wherein failure to direct a serving ball into said area results in scoring a point by the non-serving player.

31. The method of claim 29, wherein the at least one defined area on the ground defines a court which limits the movements of a player to movements within said court.

32. The method of claim 29, wherein difficulty degree of the game is determined by at least one of the following: the frame size, the gate size, the distance between the frame and the gate, the type of the ball, the type of the paddles and by the at least one defined area on the ground.

* * * * *